United States Patent [19]

Hofacker

[11] Patent Number: 5,050,261

[45] Date of Patent: Sep. 24, 1991

[54] ANGULARLY ADJUSTABLE ADAPTER FOR PAINT ROLLERS

[76] Inventor: Roland J. Hofacker, 5325 Carmilfra Dr., Sarasota, Fla. 34231

[21] Appl. No.: 624,559

[22] Filed: Dec. 10, 1990

[51] Int. Cl.[5] ..... B05C 17/02

[52] U.S. Cl. ..... 15/144 R; 15/230.11

[58] Field of Search ..... 15/144 R, 145, 230.11; 403/61, 85, 91; 29/110.5; 16/110 R, 114 R

[56] References Cited

U.S. PATENT DOCUMENTS

| | | | |
|---|---|---|---|
| 3,273,192 | 9/1966 | Mazzella | 15/230.11 |
| 3,408,676 | 11/1968 | Cayo | 15/230.11 |
| 3,419,931 | 1/1969 | Willig | 15/144 R |
| 3,866,257 | 2/1975 | Cansdale, Sr. | 15/230.11 |
| 4,038,716 | 8/1977 | Polsfuss | 15/144 R |
| 4,089,082 | 5/1978 | McGrew | 15/230.11 |
| 4,528,714 | 7/1985 | Beck | 15/144 R |

FOREIGN PATENT DOCUMENTS

| | | | |
|---|---|---|---|
| 1190520 | 7/1985 | Canada | 15/230.11 |

*Primary Examiner*—Edward L. Roberts

*Attorney, Agent, or Firm*—Charles J. Prescott

[57] ABSTRACT

An angularly adjustable adapter for paint rollers which connects into the handle of the paint roller. The device includes a pivotable knuckle, the first end of which connects to the paint roller handle. The second end of the knuckle is connected to an elongated downwardly extending extension arm and includes opposing outwardly facing friction surfaces. Two elongated spaced apart friction bars are pivotally connected at their upper ends to the knuckle first end about a common transverse axis and extend downwardly against and past the friction surfaces to a lower slotted transverse connection with respect to the extension arm. After the knuckle is manually angularly pivoted, the friction bars acting against the friction surfaces automatically maintain the preselected angle during painting use, also adding additional lateral ridigity to the knuckle.

3 Claims, 2 Drawing Sheets

ANGULARLY ADJUSTABLE ADAPTER FOR PAINT ROLLERS

BACKGROUND OF THE INVENTION

This invention relates generally to paint rollers, and more particularly to an angularly adjustable paint roller which can be easily angularly adjustable and will automatically any angle of the paint roller with respect to the extension arm during use.

When painting the upper portions of walls, ceilings and angular surfaces, the user typically finds it awkward to reach those upper edge limits, e.g. the upper edge of the wall against the ceiling. If a ladder is used to elevate the user, then repeated "up and down and move the ladder sideways" activity is required.

A number of devices have been invented to angularly adjust the paint roller with respect to the extension arm so as to assist in continuous ground or floor level painting without the need for body elevation aids.

One such device is disclosed in U.S. Pat. No. 4,089,082 to McGrew which is directed to a multi-position paint roller frame. However, this device has a diagonally extending elbow brace which appears to provide only predetermined optimum incremental angular adjustment of the paint roller.

Other patented devices known to applicant for accomplishing this similar angularly positionable function are as follows:

| | |
|---|---|
| Mazella | 3,273,192 |
| Willig | 3,419,931 |
| Cansdale | 3,866,257 |
| Polsfus | 4,038,716 |
| Beck | 4,528,714 |

One of the limitations that appears to be present in all of these prior art devices is that the adjustability of the paint roller must be in conjunction with the loosening and tightening action of some portion of the device or its connecting members. The present invention provides for easy angular adjustability of the paint roller without the need for loosening and tightening or dismantling of any component, while also providing a high degree of built-in automatic tensioning to maintain any selected angle and additional lateral rigidity to the entire device.

BRIEF SUMMARY OF THE INVENTION

This invention is directed to an angularly adjustable adapter for paint rollers which connects into the handle of the paint roller. The device includes a pivotable knuckle, the first end of which connects to the paint roller handle. The second end of the knuckle is connected to an elongated downwardly extending extension arm and includes opposing outwardly facing friction surfaces. Two elongated spaced apart friction bars are pivotally connected at their upper ends to the knuckle first end about a common transverse axis and extend downwardly against and past the friction surfaces to a lower slotted transverse connection with respect to the extension arm. After the knuckle is manually angularly pivoted, the friction bars acting against the friction surfaces automatically maintain the preselected angle during painting use, also adding additional lateral rigidity to the knuckle.

It is therefore an object of this invention to provide an angularly adjustable adapter for paint rollers which will automatically maintain any angular adjustment of the paint roller during use without the need for manipulation, loosening or tightening of any components thereof.

It is another object of this invention to provide the broadest possible angular adjustment of the paint roller without loss of strength or angular rigidity.

It is yet another object of this invention to provide an angularly adjustable adapter for paint rollers which provides for a high degree of wearability and lateral strength.

In accordance with these and other objects which will become apparent hereinafter, the instant invention will now be described with reference to the accompanying drawings.

DETAILED DESCRIPTION OF THE INVENTION

Figures 1, 4:
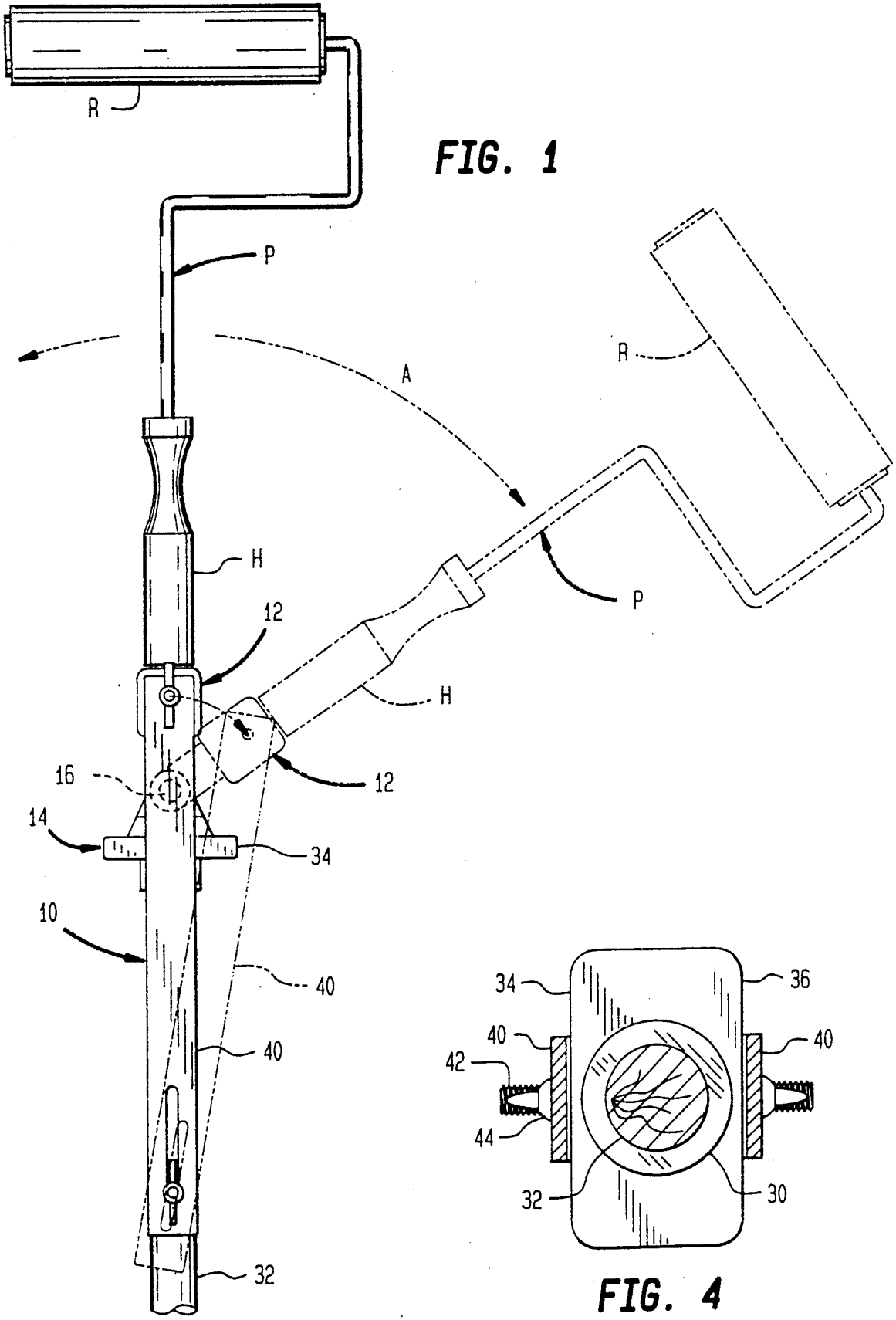
FIG. 1 is a side elevation view of the invention showing a paint roller attached thereto and depicting the angular adjustability in phantom.
FIG. 4 is a section view in the direction of arrows 4—4 in FIG. 3.

Referring now to the drawings, and firstly to FIG. 1, the invention is shown generally at numeral 10 and includes a first or upper knuckle member 12 and a second or lower knuckle member 14 which are pivotally connected about transverse pin 16. The device 10 is structured for interconnection to a paint roller P as a downwardly coaxial extension of handle H so that the paint roller P may be pivotally articulated back and forth in the direction of arrow A so as to provide any desired angular orientation of roller R during use.

Figure 2:
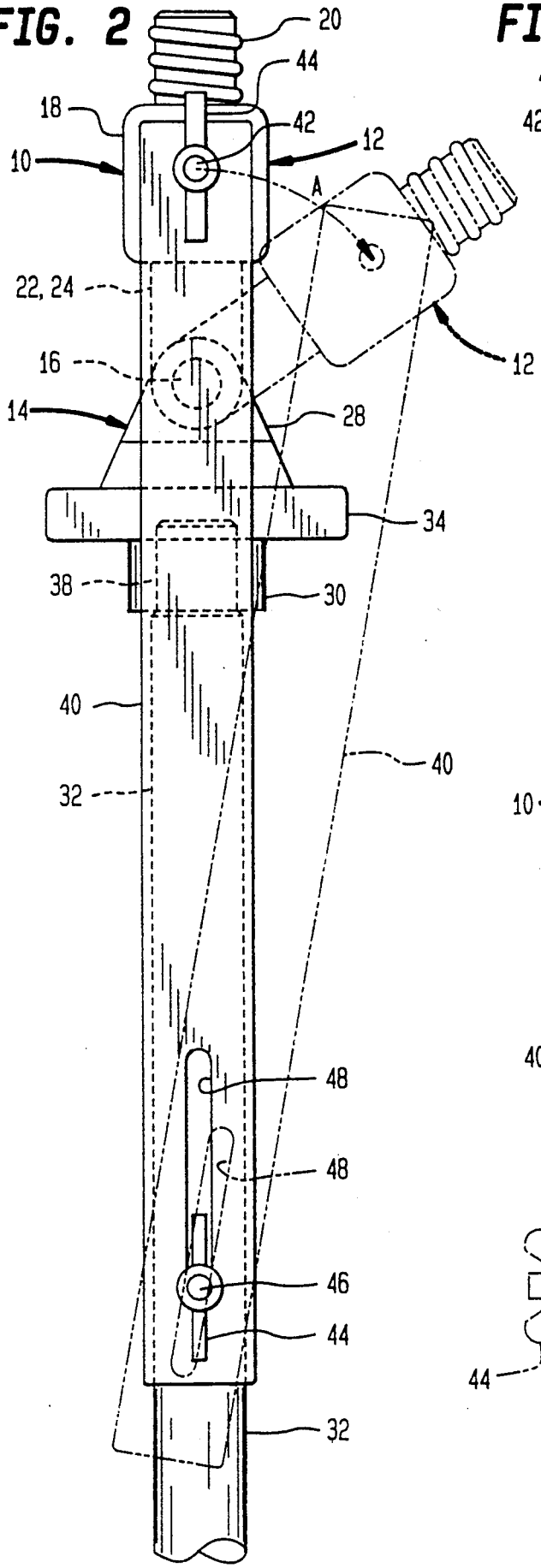
FIG. 2 is an enlarged side elevation view of the invention as shown in FIG. 1.
Figure 3:
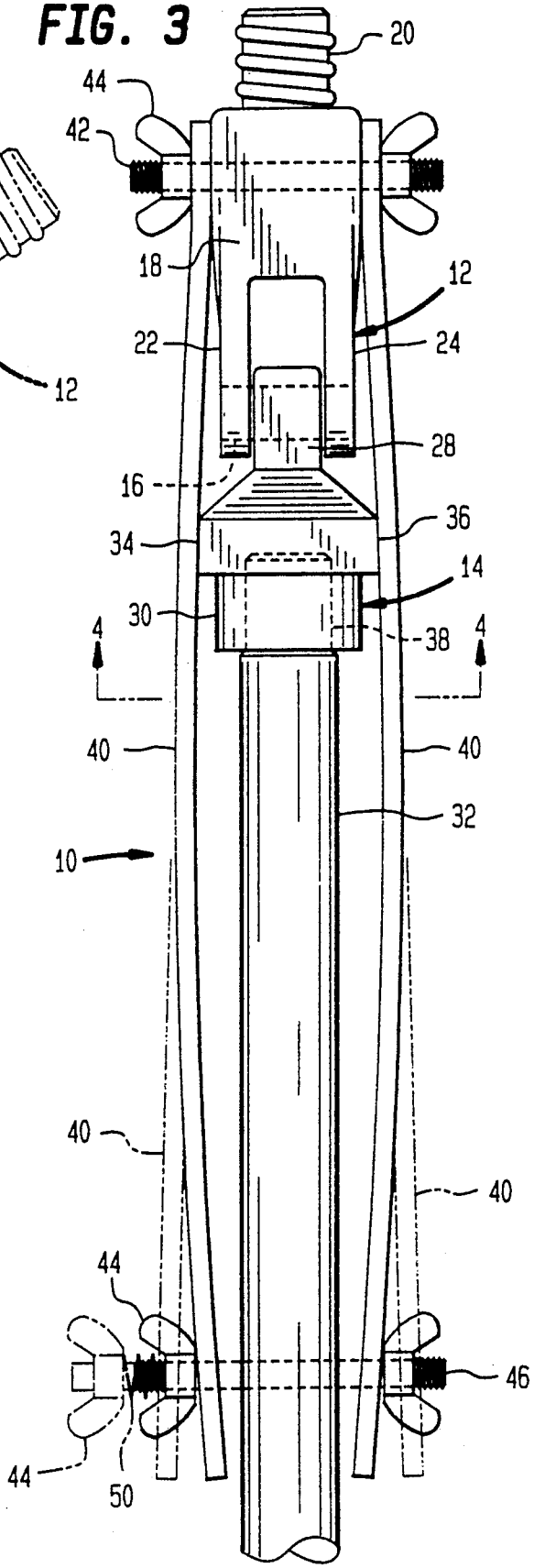
FIG. 3 is an end elevation view of FIG. 2.

Referring now additionally to FIGS. 2 to 4, the upper distal end of first formed member 12 includes a threaded shaft 20 which will threadably engage into the handle H of paint roller P. Its main body 18 downwardly extends downwardly to clevises 22 and 24 which pivotally connect about pin 16 to the upper end 28 of second formed member 14. The lower main body portion 30 includes a threaded cavity 38 which is structured to threadably receive the upper end of a wooden extension arm 32.

As may be now understood, this arrangement thus far described may be angularly articulated from coaxial alignment to any desired acute angle A in either direction about pin 16 as shown in phantom in FIGS. 1 and 2.

In order to automatically maintain any desired angular orientation between first and second members 12 and 14, a pair of spaced, elongated metal friction bars 40 formed of relatively stiff metal are positioned on either side of outwardly opposing friction surfaces 34 and 36 formed into second member 14. The upper ends of friction bars 40 are connected to main body member 18 about transverse threaded bolt 42, held thusly by tightened wing nuts 44.

Friction arms 40 extend longitudinally downwardly to transverse threaded bolt 46 which is rigidly mounted transversely within a wooden extension arm 32. Longitudinal slots 48 are provided in each friction arm 40 so as to slidably translate over bolt 46, held thusly by wing nuts 44.

Outwardly opposing friction surfaces 34 and 36 are positioned such that wing nuts 44 may be tightened on each extending end of bolt 46 toward the extension arm 32 so as to resiliently bend the friction arms 40 from a straight position shown in phantom in FIG. 3 to a bowed inwardly position shown in solid in that figure. This accomplishes a substantial increased pressure between the inner surfaces of the friction bars 40 and the friction surfaces 34 and 36. The increased friction results in the ability to manually pivotally realign upper member 12 with respect to lower member 14 and to have that angular relationship automatically maintained during use of the device in applying paint.

Although wing nuts 44 on shaft 46 may be adjustably tightened so as to vary the amount of friction against friction surfaces 34 and 36, an alternate embodiment is shown in phantom in FIG. 3 wherein a compression spring 50 is positioned between wing nut 44 and the outer surface of each friction bar 40 to further expand the breadth of adjustment of the device to accommodate any wear of the friction surfaces 34 and 36 and to also provide for enhanced "fine tuning" of the friction adjustment to suit each user. Utilizing the compression springs 50, friction arm 40 may be made substantially more rigid so that all of the tension adjustability resides in the level of compression of springs 50 only.

Friction surfaces 34 and 36 are elongated transversely so as to always remain in contact against the inner surfaces of friction arms 40, regardless of the angle A through which the first member 12 is angularly adjusted with respect to the longitudinal axis of second member 14 and extension arm 32.

The preferred materials for use are molded filled plastic material in first and second members 12, 14 and pin 16 and aluminum or mild steel bar stock in forming friction bars 40. Threaded bolts 42 and 46 may be threadably or adhesively connected within main body member 18 and wooden arm extension 32, respectively.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so a to embrace any and all equivalent apparatus and articles.

What is claimed is:

1. An angularly adjustable adapter for paint rollers comprising:

a pivotable knuckle having a longitudinal axis and including first and second formed members pivotable one to another about a central transverse axis;

said first member having an upper distal end structured for coaxial engagement into the distal end of a handle of a paint roller;

said second member having a lower distal end structured for coaxial engagement with an elongated extension arm;

said second member also having two spaced opposing generally parallel outwardly facing friction surfaces oriented perpendicularly to said central transverse axis;

an elongated friction bar positioned on either side of said knuckle pivotally connected at an upper end to a midpoint of said first member about an upper transverse axis spaced above and parallel to said central transverse axis;

said friction bars parallel and spaced apart and extending downwardly below the corresponding said friction surfaces to a lower transverse pivotal connection of the lower ends of said friction bars about a lower transverse axis passing through said extension arm;

said lower and upper transverse axes parallel;

said friction surfaces spaced apart sufficiently such that, the lower ends of said friction bars being compressively biased toward said extension arm at said lower transverse pivotal connection, said friction bars are biased against the corresponding said friction surfaces;

said friction surfaces having sufficient transverse length to maintain friction contact against said friction bars when said first and second members are pivoted at an acute angle out of axial alignment one to another sufficiently to maintain any preselected angle during painting use;

said friction bars slotted longitudinally at said lower pivotal connection to allow the lower end of said friction bars to articulate downwardly as well as pivotally about said lower pivotal connection as said first and second members are pivoted out of axial alignment one to another.

2. An angularly adjustable adapter for paint rollers comprising:

a pivotable knuckle including first and second formed members pivotably connected one to another about a central transverse axis;

said first member having an upper distal end structured for engagement into a handle of a paint roller;

said second member having a lower distal end structured for coaxial engagement with an elongated lower extension arm;

said second member also having two spaced opposing generally parallel outwardly facing friction surfaces;

a generally rigid yet resiliently bendable elongated straight friction bar extending along either side of said knuckle and against said friction surfaces pivotally connected at an upper end to a common mid point of said first member about an upper transverse axis spaced above and parallel to said central transverse axis;

said friction bars extending downwardly below the corresponding said friction surfaces to a common lower transverse pivotal connection of the lower ends of said friction bars about a lower transverse axis passing through said extension arm;

said lower and upper transverse axes parallel;

each said friction surface extending laterally outwardly beyond a plane defined by the surfaces of the corresponding said first formed member and said extension arm at said upper and lower transverse pivotal connection, respectively;

said friction surfaces having sufficient transverse length to maintain friction contact against said friction bars when said first and second members are pivoted at an acute angle in either direction out of axial alignment one to another;

said friction bars slotted longitudinally at said lower pivotal connection to allow the lower end of said friction bars to articulate downwardly as well as pivotally about said lower pivotal connection as said first and second members are pivoted out of axial alignment one to another.

3. An angularly adjustable adapter for paint rollers comprising:

a pivotable knuckle including first and second formed member pivotably connected one to another about a central transverse axis;

said first member having an upper distal end structured for coaxial connection with a handle of a paint roller;

said second member having a lower distal end connected coaxially to an elongated lower extension arm;

said second member also having two spaced opposing generally parallel outwardly facing friction surfaces;

a generally rigid yet resiliently bendable elongated straight friction bar extending lengthwise along either side of said knuckle and against said friction surfaces, each pivotally connected at an upper end to a first shaft mounted transversely through and extending in either direction from said first member about an upper transverse axis spaced above and parallel to said central transverse axis;

said friction bars extending downwardly below the corresponding said friction surfaces to aligned longitudinal slots formed in each said friction bar extending upwardly from a lower end thereof, said slots slidably and pivotably connected to a second shaft mounted transversely through said extension arm about a lower transverse axis passing through said extension arm;

said lower and upper transverse axes parallel;

each said friction surface extending laterally outwardly beyond a plane defined by the surfaces of the corresponding said first formed member and said extension arm at said upper and lower transverse pivotal connection, respectively;

said friction surfaces having sufficient transverse length to maintain friction contact against said friction bars when said first and second members are pivoted at an acute angle in either direction out of axial alignment one to another;

said slots of sufficient length to allow the lower end of said friction bars to articulate downwardly as well as pivotally about said lower pivotal connection as said first and second members are pivoted out of axial alignment one to another.

* * * * *